US007249576B2

(12) United States Patent
Jones

(10) Patent No.: US 7,249,576 B2
(45) Date of Patent: Jul. 31, 2007

(54) LOW TEMPERATURE THERMOSTAT HOUSING SYSTEM FOR AN ENGINE

(75) Inventor: R. David Jones, Charleston, SC (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 11/285,410

(22) Filed: Nov. 21, 2005

(65) Prior Publication Data

US 2007/0113801 A1 May 24, 2007

(51) Int. Cl.
*F01P 1/06* (2006.01)
*F01P 3/00* (2006.01)

(52) U.S. Cl. ..... 123/41.31; 123/41.29; 123/563

(58) Field of Classification Search ..... 123/41.31, 123/41.33, 563, 196 AB, 41.29, 41.08, 41.09
See application file for complete search history.

(56) References Cited

U.S. PATENT DOCUMENTS 3,863,612 A * 2/1975 Wiener ..... 123/563
4,621,594 A * 11/1986 Kubis ..... 123/41.31

FOREIGN PATENT DOCUMENTS

JP 07004251 A * 1/1995

* cited by examiner

*Primary Examiner*—Noah P. Kamen
(74) *Attorney, Agent, or Firm*—Sawyer Law Group LLP

(57) ABSTRACT

An aftercooler thermostat housing for an engine is disclosed. The housing system comprises a housing and a thermostat within the housing. The housing system further includes a bypass system for providing a connection to allow an engine coolant to flow to the aftercooler system if the engine coolant temperature is below a first predetermined temperature. The bypass system allows for the engine coolant to flow through a heat exchanger which is part of the aftercooler system if the temperature of the coolant is above the first predetermined temperature. A low temperature aftercooler (LTA) thermostat housing system achieves the necessary heat rejection for the engine via the heat exchanger and achieves low temperature aftercooling using the heat exchanger.

11 Claims, 3 Drawing Sheets

10

34'

LOW TEMPERATURE THERMOSTAT HOUSING SYSTEM FOR AN ENGINE

FIELD OF THE INVENTION

The present invention relates generally to engines and more specifically to an aftercooler thermostat housing system for such engines.

BACKGROUND OF THE INVENTION

In a conventional cooling system for an internal combustion engine, the coolant is circulated by a circulating pump through the engine block, through the cylinder heads, eventually through the intake manifold. In an automobile, or other land vehicle, the coolant flows through a radiator. Most marine engines do not have a radiator. In a marine engine having an open loop cooling system, sea water supplied by a sea water pump is used to directly cool the engine and is then discharged overboard.

Other engines have closed loop cooling systems. In a closed loop cooling system, an engine coolant circulates through the engine and then through a heat exchanger.

In closed loop cooling systems, the flow of engine coolant through the heat exchanger is controlled by a thermostat on the engine block of the engine. When the engine and engine coolant are cold, the thermostat is closed so that coolant does not pass through the heat exchange. With the thermostat closed, a small portion of engine coolant flows through a bypass and returns a limited amount of coolant to the circulating pump, so that there is a sufficient engine coolant flow through the engine block while the system is warming up. While a limited amount of engine coolant is adequate when the engine warms up slowly, problems can occasionally exist if the operator runs the engine wide open before the engine and coolant have warmed up. Under these conditions, coolant flow through the engine bypass before the thermostat opens might not provide sufficient cooling. This can be critical because wide open operation can quickly to hot spots in the an engine. The present invention addresses such a need.

SUMMARY OF THE INVENTION

An aftercooler thermostat housing for an engine is disclosed. The housing system comprises a housing and a thermostat within the housing. The housing system further includes a bypass system for providing a connection to allow an engine coolant to flow to the aftercooler system if the engine coolant temperature is below a first predetermined temperature. The bypass system allows for the engine coolant to flow through a heat exchanger which is part of the aftercooler system if the temperature of the coolant is above the first predetermined temperature. A low temperature aftercooler (LTA) thermostat housing system achieves the necessary heat rejection for the engine via the heat exchanger and achieves low temperature aftercooling using the heat exchanger.

DETAILED DESCRIPTION

The present invention relates generally to engines and more specifically to an aftercooler thermostat housing system for such engines. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

A low temperature aftercooler (LTA) thermostat housing system is disclosed for an engine in order to achieve the necessary heat rejection for the engine via the heat exchanger and to achieve low temperature aftercooling using the heat exchanger.

Figure 1:
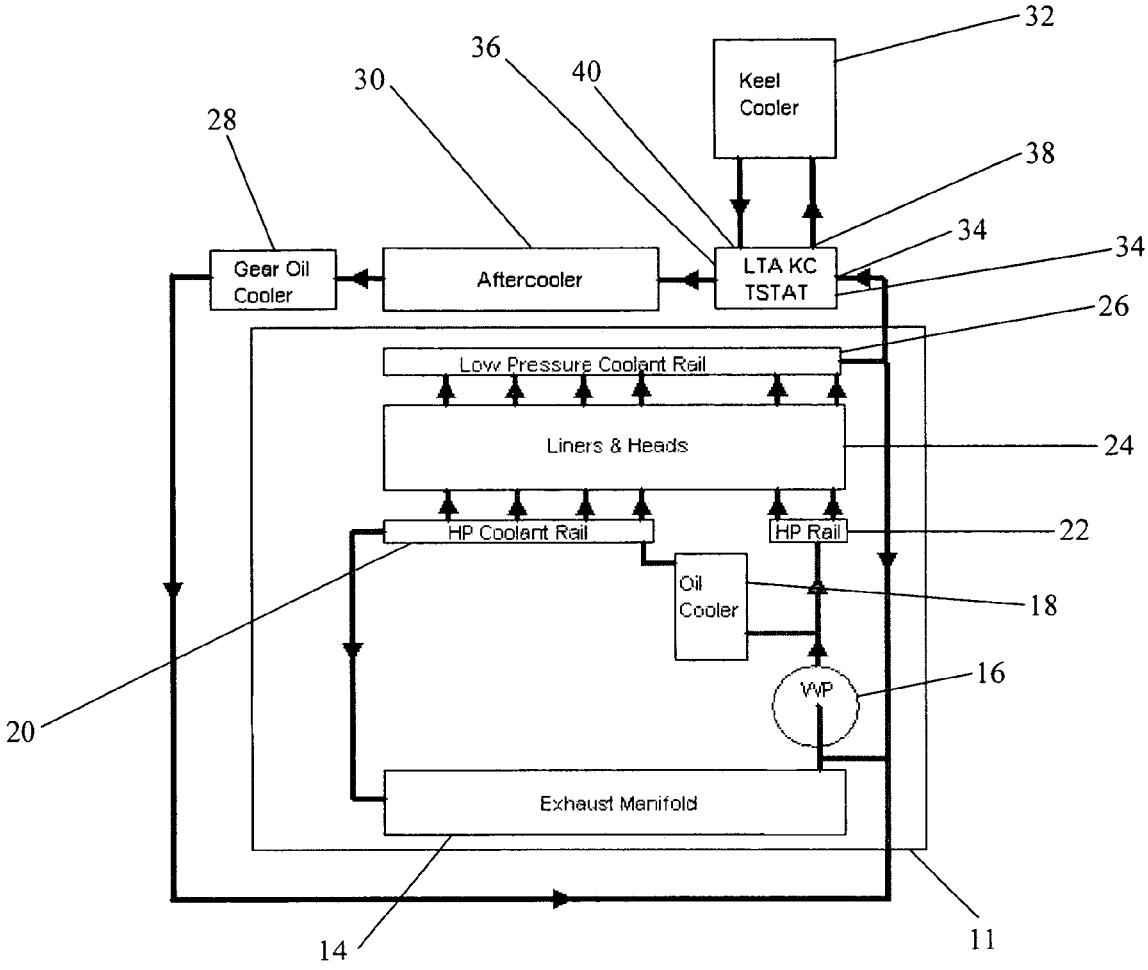
FIG. 1 shows an internal combustion engine system that includes an engine and an aftercooler system in accordance with the present invention.

FIG. 1 shows an internal combustion engine system 10 that includes an engine 11 and an aftercooler system 12 in accordance with the present invention. The engine system 10 comprises an exhaust manifold 14 and receives coolant from a water pump (WP) 16. The water pump 16 provides coolant to an oil cooler 18 and a high pressure coolant rail 20. The oil cooler 18 provides coolant to a second high pressure coolant rail 20 which in turn directs coolant to the liners and heads system 24 of the engine 11. The liners and heads system 24 of the engine provide coolant to the low pressure coolant rail 26. The low pressure coolant rail 26 and the exhaust manifold 14 provide coolant to the aftercooler system 12.

The external system 12 comprises an oil cooler 28, an aftercooler 30, a heat exchanger 32 and a low temperature aftercooler (LTA) thermostat housing system 34 in accordance with the present invention. The aftercooler 30 cools compressed air from the engine. It is after the turbo in the air flow stream. The oil cooler 28 cools gear oil. The LTA thermostat housing system 34 is mounted external to the base engine. The LTA thermostat housing system 34 regulates the volume of external water flow through the low temperature aftercooler 30 and the heat exchanger 32. The heat exchanger can be a variety of types dependent on the engines used. For example, the heat exchanger could be a radiator, a skin cooler, a keel cooler and the like and its use would be within the spirit and scope of the present invention. The LTA thermostat housing system 34 piping is also designed to regulate the volume of bypass water flow.

Figure 2:
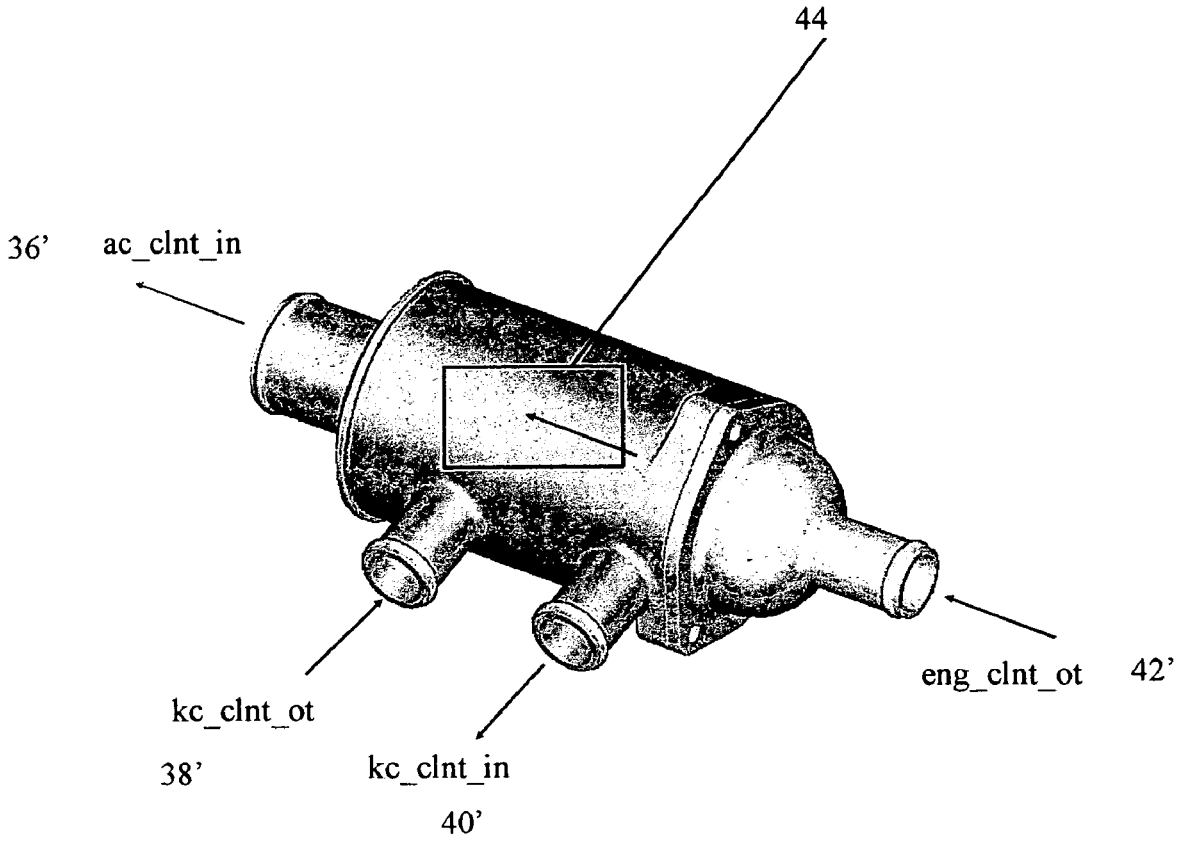
FIG. 2 is a perspective view of the LTA thermostat housing system in accordance with the present invention.

FIG. 2 is a perspective view of the LTA thermostat housing system 34' in accordance with the present invention. The thermostat housing system 34' includes a thermostat such as Model No. 3349225 manufactured by Coopers Inclusive. The thermostat housing system 34' includes a coolant bypass system 44 which includes an input 42' that receives coolant from the engine and an output 36 which provides coolant to the aftercooler 30, and an input 40 which provides coolant to the heat exchanger 32 and an output 38 which receives coolant from the heat exchanger 32.

Referring to FIGS. 1 and 2 together, the LTA thermostat housing system 34 regulates the volume of flow to the heat exchanger 32 in order to maintain relatively constant intake manifold temperatures exiting the aftercooler 30. When the engine coolant is at a predetermined temperature, such as 150° Fahrenheit or lower, the thermostat housing system 34 directs the engine coolant to flow directly through the aftercooler 30, gear oil cooler 28, and through the engine 11. When the engine coolant is above the predetermined temperature (150° F.), then the thermostat housing system 34 directs the engine coolant through the external heat exchanger 32 before directing it to the aftercooler 30, gear oil cooler 28, and back to engine 10.

When the engine coolant is at a predetermined temperature or below that temperature, the coolant flows into the thermostat housing system 34 at the intake 42, and out from the thermostat housing system 34 through the engine output 36. When the engine coolant is above a predetermined temperature, the coolant flows into the thermostat housing system 34 at the intake 42. The bypass system 44 then directs the coolant to flow out of the thermostat housing system 34 from the heat exchanger input 40. After the coolant has passed through the heat exchanger 32, then the coolant returns to the thermostat housing system 34 via the heat exchanger output 38. The coolant is then directed by the bypass mechanism 44 towards the engine 11, out of engine output 36.

FIG. 1 shows an internal combustion engine system 10 that includes an engine 11 and an aftercooler system 12 in accordance with the present invention. The engine system 10 comprises an exhaust manifold 14 and receives coolant from a water pump (WP) 16. The water pump 16 provides coolant to an oil cooler 18 and a high pressure coolant rail 22. The oil cooler 18 provides coolant to a second high pressure coolant rail 20 which in turn directs coolant to the liners and heads system 24 of the engine 11. The liners and heads system 24 of the engine provide coolant to the low pressure coolant rail 26. The low pressure coolant rail 26 and the exhaust manifold 14 provide coolant to the aftercooler system 12.

Figure 3:
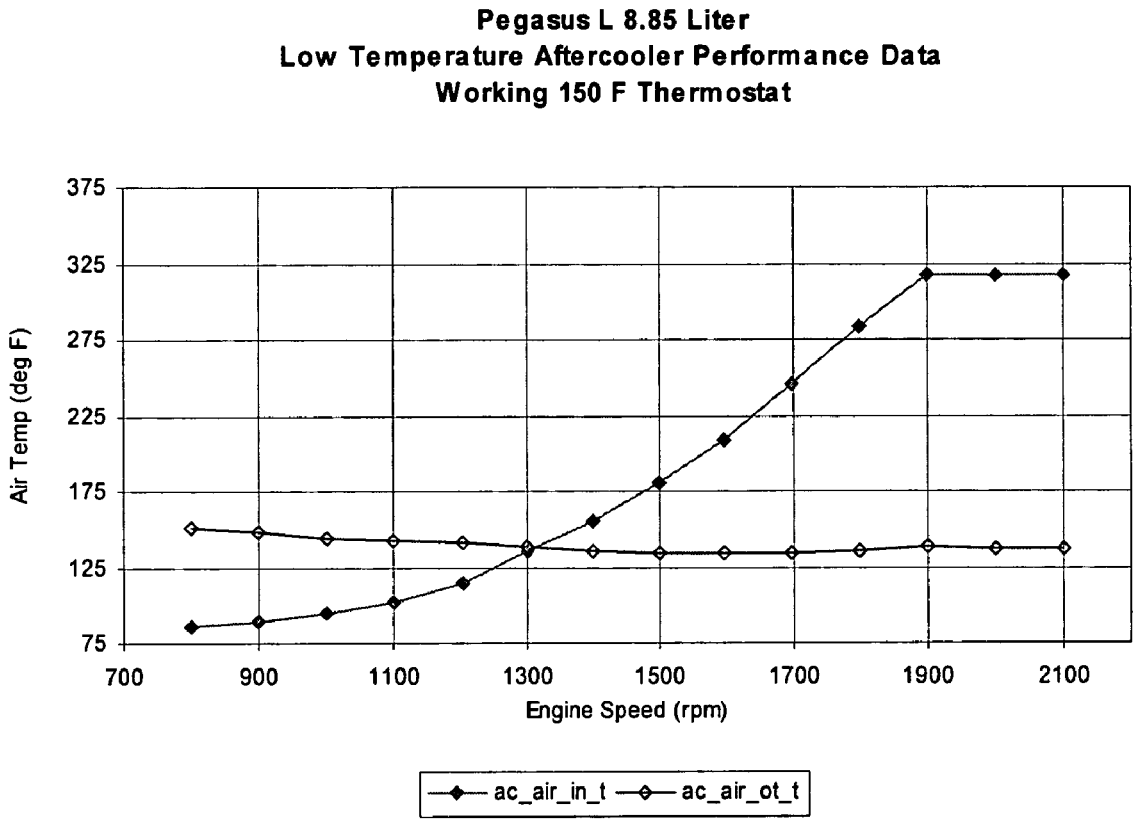
FIG. 3 is a graph showing performance data for an L 8.85 Liter-Low Temperature Aftercooler operating with a working 150° F. Thermostat.

FIG. 3 is a graph showing performance data for an L 8.85 Liter-Low Temperature Aftercooler operating with a working 150° F. Thermostat. As can be seen from the performance data, the temperature of the air at the input opening increases from approximately 80 degrees Fahrenheit when the engine speed is in the 800 rpm range to approximately 300 degrees Fahrenheit when the engine speed is at 2100 rpm. As the engine speed increases, the output remains relatively constant, decreasing slightly, from approximately 150 degrees Fahrenheit at low engine speeds to approximately 130 degrees Fahrenheit at maximum engine speed.

Advantages

The low temperature aftercooler (LTA) thermostat housing has the following advantages:

Constant change in pressure at a fully closed and open thermostat

Relatively constant intake manifold temperature at all prop curve loads and engine speeds.

Small compact, universal mounting

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A thermostat housing system for use with an aftercooler of an engine, the housing system comprising:

a housing;

a thermostat within the housing; and a bypass system having a first output to direct engine coolant to flow to the aftercooler when the thermostat senses that the engine coolant temperature is below a predetermined temperature, a second output to direct engine coolant to flow to a heat exchanger when the thermostat senses that the temperature of the engine coolant is above the predetermined temperature, wherein the engine coolant is directed back through a first input of the bypass system to receive engine coolant from the heat exchanger and subsequently directed to the aftercooler through the first output.

2. The thermostat housing system of claim 1 wherein the engine is utilized in a marine application and the heat exchanger comprises a keel cooler.

3. The thermostat housing system of claim 1 wherein the engine is utilized in a land application and the heat exchanger comprises a radiator.

4. A system comprising:

an engine;

a cooling system coupled to and separate from the engine, the cooling system including:

a heat exchanger; and a thermostat housing system having coupled to the heat exchanger for receiving coolant from the engine, the thermostat housing system senses the temperature of the coolant and re-circulates the coolant back to the engine through a first thermostat housing system output when the thermostat housing system senses that the coolant temperature is below a predetermined value and wherein the thermostat housing system directs the coolant to the heat exchanger through a second thermostat housing system output then back to a first thermostat housing system input and then back to the engine when the thermostat housing system senses that the temperature is above a predetermined value.

5. The system of claim 4 wherein the heat exchanger comprises any of a keel cooler, radiator, or a skin cooler.

6. The system of claim 4 wherein the thermostat housing system comprises:

a housing;

a thermostat within the housing; and a coolant bypass system for directing the coolant to the engine or the heat exchanger based upon the temperature of the coolant.

7. The system of claim 4 which further includes:

an aftercooler for receiving coolant from the thermostat housing; and a gear oil cooler for receiving coolant from the aftercooler and providing the coolant to the engine.

8. A system for an engine comprising:

an aftercooler;

a heat exchanger; and a thermostat housing system coupled between the aftercooler and the heat exchanger; the thermostat housing system comprising a housing; a thermostat within the housing; and a bypass system for providing a connection to allow an engine coolant to flow directly to the aftercooler through a first thermostat housing system output when the thermostat housing system senses that the engine coolant temperature is below a predetermined temperature and for directing the engine coolant to flow through the heat exchanger through a second thermostat housing system output when the temperature is above the predetermined temperature, wherein the engine coolant is directed back through a first thermostat housing system to receive engine coolant from the heat exchanger and subsequently directed to the aftercooler through the first output.

9. The system of claim 8 wherein the engine is utilized in a marine application and the heat exchanger comprises a keel cooler.

10. The system of claim 8 wherein the engine is utilized in a land application and the heat exchanger comprises a radiator.

11. The system of claim 8 which includes a gear oil cooler coupled to the aftercooler for providing coolant for the engine.

* * * * *